US006082573A

United States Patent [19]

Hofman et al.

[11] Patent Number: 6,082,573

[45] Date of Patent: Jul. 4, 2000

[54] ROTATABLE STANDOFF FOR SHOWER CADDY BUCKET

[75] Inventors: James A. Hofman, Hockessin; Paul Winter, Wilmington, both of Del.; Paul Wojtowicz, Downingtown, Pa.

[73] Assignee: Zenith Manufacturing Corp., New Castle, Del.

[21] Appl. No.: 09/301,708

[22] Filed: Apr. 29, 1999

Related U.S. Application Data

[60] Provisional application No. 60/111,986, Dec. 12, 1998.

[51] Int. Cl.[7] ..... B65D 25/24

[52] U.S. Cl. ..... 220/480; 220/483

[58] Field of Search ..... 220/480, 483; 211/86.01, 87.01, 88.01, 95

[56] References Cited

U.S. PATENT DOCUMENTS 1,696,483 12/1928 Hiering .
2,214,869 9/1940 West .
2,286,012 6/1942 Rochow .
2,446,016 7/1948 Lessin .
2,650,698 9/1953 Castner .
5,485,927 1/1996 Hubbard .

*Primary Examiner*—Stephen Castellano
*Attorney, Agent, or Firm*—Edgar A. Zarins; Lloyd D. Doigan

[57] ABSTRACT

A shower caddy bucket having a rotatable standoff for positioning a bottom portion of the bucket away from the wall to which the caddy is mounted. The bucket has a tapered configuration with a narrower bottom end. The standoff has an elongated configuration and is selectively rotatable between a stored position parallel to the wall and a standoff position perpendicular to the wall. In the standoff position, an end of the standoff will engage the wall to maintain the bottom end of the caddy bucket spaced away from the wall.

14 Claims, 2 Drawing Sheets

ROTATABLE STANDOFF FOR SHOWER CADDY BUCKET

This application claims the priority of U.S. Provisional Patent Application No. 60/111,986 filed on Dec. 12, 1998.

BACKGROUND OF THE INVENTION

I. Field of the Invention

This invention relates to a bucket for storage of commodity items and, in particular, to a bucket caddy attachable to a wall or other flat surface and having a rotatable stand-off to ensure the bucket is maintained at a level position.

II. Description of the Prior Art

Consumers have demanded conveniences throughout the home. Such conveniences even extend to such aspects as the shower, bath or within cabinets where users desire convenient storage for easy access to items. The prior known storage units have included corner caddies which may have a plurality of shelves supported on a pole extending vertically. Bucket caddies may be mounted to the walls of the bathing unit to provide deeper wells for storing bathing items. However, the attachment of such storage devices can pose a problem particularly on irregular surfaces such as tiled walls. Suction cups require a smooth clean surface to maintain engagement. Any permanent securement such as threaded fasteners prevent the storage bucket from being conveniently removed for cleaning. And it is desirable to maintain such storage devices in a level orientation to properly store items.

SUMMARY OF THE PRESENT INVENTION

The present invention overcomes the disadvantages of the prior known caddy buckets by providing a rotatable standoff to maintain the bucket in a substantially level position when mounted to a vertical flat surface either by suction cups or fixed fasteners.

The caddy of the present invention includes a bucket with means for securing the caddy to a wall of the bathing unit such as suction cups or fasteners. The bucket has a tapered configuration with a narrower bottom end. In order to maintain the bucket in a level position, a rotatable standoff is mounted to the bottom of the bucket. The standoff has an elongated configuration and is selectively rotatable between a stored position parallel to the wall and a standoff position perpendicular to the wall. In the standoff position, an end of the standoff will engage the wall to maintain the bottom end of the bucket spaced away from the wall.

Other objects, features and advantages of the invention will be apparent from the following detailed description taken in connection with the accompanying drawings.

BRIEF DESCRIPTION OF THE DRAWING

The present invention will be more fully understood by reference to the following detailed description of a preferred embodiment of the present invention when read in conjunction with the accompanying drawing, in which like reference characters refer to like parts throughout the views and in which.

DETAILED DESCRIPTION OF A PREFERRED EMBODIMENT OF THE PRESENT INVENTION

Figure 1:
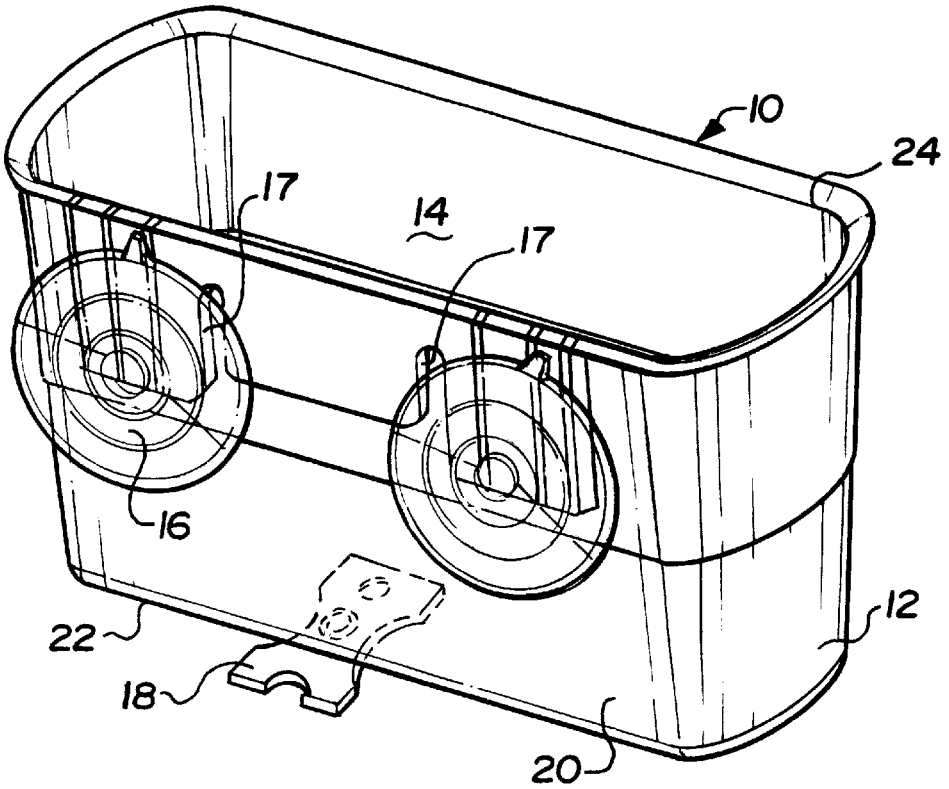
FIG. 1 is a rear perspective view of a caddy bucket embodying the present invention.
Figure 2:
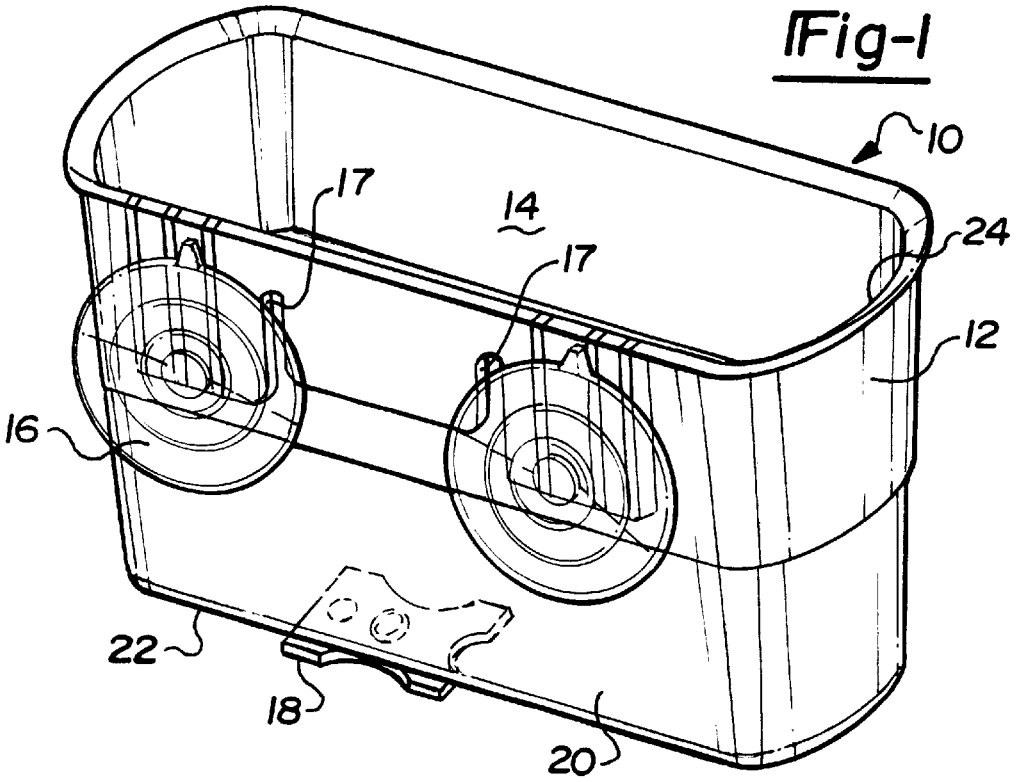
FIG. 2 is a rear perspective view of the caddy bucket showing the standoff in a retracted position.

Referring to the drawing, there is shown a bucket caddy 10 embodying the present invention and adapted to be mounted to a vertical surface. The caddy 10 includes a bucket 12 forming a well 14 for retaining bottles, soaps, cleaning items, etc. in a convenient place. The bucket 12 is preferably secured to the wall using suction cups 16. A rotatable standoff 18 is preferably mounted to the underside of the bucket 14 so as to selectively engage the wall and maintain the bottom of the bucket 14 away from the wall (FIG. 5) thereby mounting the bucket 14 in a substantially level position. Alternatively, fasteners may be secured to the vertical surface for "hanging" the bucket 12.

The bucket caddy 10 is adapted to be mounted to a vertical surface such as in a bathing unit in order to keep bathing items in convenient proximity to the bather. The bucket caddy 10 is designed to retain shampoo bottles and soaps in a convenient placement by securing the caddy 10 as required. In a preferred embodiment, the caddy 10 includes suction cups 16 to mount the caddy 10 to a smooth vertical surface within the bathing unit. Formed in the rear of the bucket 12 are notches 17 for receiving fasteners (not shown) secured to the vertical surface 11. Accordingly, the bucket 12 may be removably mounted to the fasteners fixed to the wall 11.

The bucket caddy 10 includes the bucket 12 defining the well 14 to hold bathing items. Preferably, the bucket 12 has at least one substantially horizontal wall 20 to which the suction cups 16 are attached and a bottom wall 22 to maintain items within the bucket 12. In one preferred embodiment, the bucket 12 has a substantially elongated configuration such that several items may be retained in the caddy 10. Additionally, the bucket 12 preferably has a tapered configuration with a bottom narrower than the top opening 24 of the bucket 12.

Figure 5:
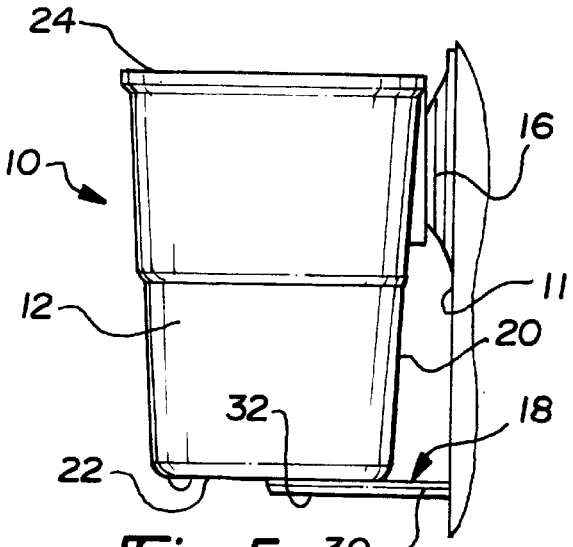
FIG. 5 is a side view of the caddy bucket mounted to the wall.

Rotatably secured to the bottom wall 22 of the bucket 12 is the standoff 18. In a preferred embodiment, the standoff 18 includes an integrally molded axle 26 which is rotatably received in an aperture 28 formed in the bottom wall 22. The standoff 18 is selectively rotatable between a stored position substantially parallel to the back wall 20 of the bucket 12 and the wall 11 to which the caddy 10 is mounted and a standoff position perpendicular to the bucket wall 20 and the wall 11. In the standoff position, the standoff 18 is configured to maintain the bottom portion of the bucket 12 in a predetermined distance from the wall 11 such that the bucket 12 is maintained in a substantially level orientation as best shown in FIG. 5.

Figure 3:
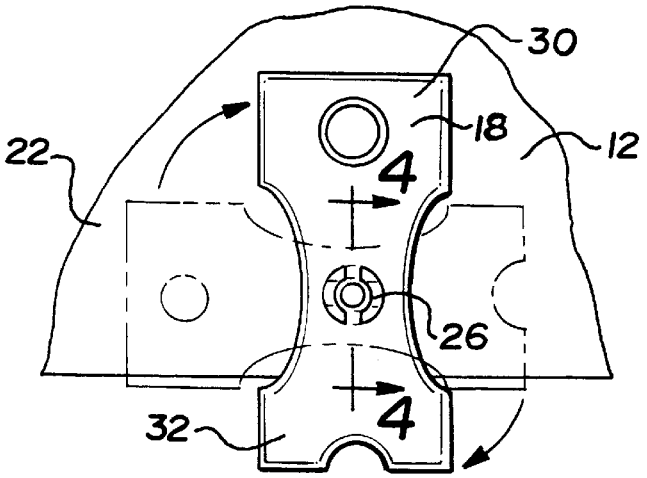
FIG. 3 is an enlarged perspective of the standoff.
Figure 4:
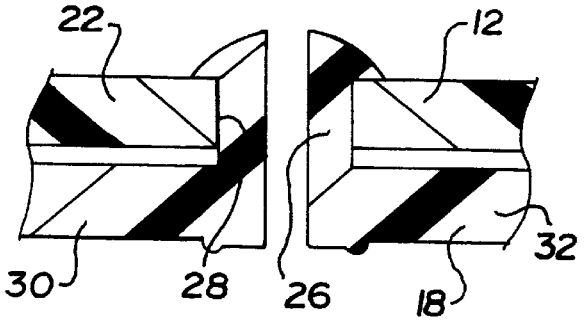
FIG. 4 is a cross-sectional view of the connection of the standoff to the caddy bucket.

The standoff 18 is rotatable not only to a stored position to facilitate packaging of the caddy 10 but rotatable between two different standoff positions. The ends of the standoff 18 relative to the axle 26 are provided with different lengths. As a result, the standoff 18 may be rotated between a first standoff position when the bucket 12 is mounted using fasteners and a second standoff position when the caddy 10 is mounted using the suction cups 16 which position the bucket 12 farther from the vertical surface 11. As best shown in FIG. 3, end 30 of the standoff 18 is longer than end 32 relative to the axis of rotation. The end 30 is designed to be used when the bucket 12 is hung using the suction cups 16 and end 32 is designed for use in conjunction with wall-mounted fasteners which would hold the bucket 12 closer to the vertical surface 11.

The foregoing detailed description has been given for clearness of understanding only and no unnecessary limitations should be understood therefrom as some modifications will be obvious to those skilled in the art without departing from the scope and spirit of the appended claims.

What is claimed is:

1. A receptacle for retaining items, said receptacle adapted to be mounted to a vertical surface, said receptacle comprising:

a bucket having an interior wall formed by peripheral walls and a bottom wall;

means for securing said receptacle to the vertical surface; and a standoff secured to said bucket, said standoff selectively movable between a stored position and a standoff position extending beyond said peripheral wall of said bucket to engage the vertical surface upon securing said receptacle to the vertical surface such that a bottom portion of said bucket is spaced from the vertical surface.

2. The receptacle as defined in claim 1 wherein said standoff has a substantially planar, elongated configuration and is secured to said bottom wall of said bucket such that said standoff is disposed substantially parallel to said bottom wall.

3. The receptacle as defined in claim 2 wherein said standoff is rotatably secured to said bottom wall of said bucket, said standoff selectively rotatable between a stored position and a standoff position extending exteriorly of said peripheral walls of said bucket.

4. The receptacle as defined in claim 3 wherein said standoff includes an integral axle, said axle rotatably received within a corresponding aperture within said bottom wall of said bucket.

5. The receptacle as defined in claim 4 wherein said standoff includes a pair of ends, said ends having different lengths such that said standoff is selectively rotatable between two different standoff positions.

6. The receptacle as defined in claim 4 wherein said peripheral walls of said bucket includes a rear wall, said means for securing said receptacle attached to said rear wall and said standoff extending outwardly of said rear wall in said standoff position.

7. The receptacle as defined in claim 6 wherein said securing means includes at least one suction cup attached to said rear wall for releasably mounting said bucket to the interior wall.

8. A receptacle for retaining items, said receptacle adapted to be mounted to a vertical surface, said receptacle comprising:

a bucket having an interior wall formed by peripheral walls and a bottom wall;

means attached to a rear peripheral wall of said bucket for securing said receptacle to the vertical surface; and a standoff rotatably secured to said bottom wall of said bucket, said standoff selectively rotatable between a stored position and a standoff position extending beyond said rear peripheral wall of said bucket to engage the vertical surface upon securing said receptacle to the vertical surface such that a bottom portion of said bucket is spaced from the vertical surface.

9. The receptacle as defined in claim 8 wherein said standoff has a substantially planar, elongated configuration.

10. The receptacle as defined in claim 9 wherein said standoff includes an integral axle, said axle rotatably received within a corresponding aperture within said bottom wall of said bucket.

11. The receptacle as defined in claim 8 wherein said securing means includes at least one suction cup attached to said rear wall of releasably mounting said bucket to the internal wall.

12. The receptacle as defined in claim 8 wherein said securing means includes at least one fastener secured to the vertical surface, said at least one fastener received within corresponding notches formed in a peripheral wall of said bucket.

13. The receptacle as defined in claim 10 wherein said standoff has a pair of ends of different length such that said standoff is selectively rotatable between said stored position and two standoff positions.

14. The receptacle as defined in claim 13 wherein said bucket includes a pair of rotatable standoffs rotatably mounted to said bottom wall.

* * * * *